US006070398A

United States Patent [19]

Neri

[11] Patent Number: 6,070,398

[45] Date of Patent: Jun. 6, 2000

[54] MACHINE FOR MAKING UP BUNDLES OF SHEETS, IN PARTICULAR BANKNOTES

[75] Inventor: Armando Neri, Bologna, Italy

[73] Assignee: G.D. S.p.A., Bologna, Italy

[21] Appl. No.: 09/006,501

[22] Filed: Jan. 14, 1998

[30] Foreign Application Priority Data

Jan. 17, 1997 [IT] Italy ..... BO97A0019

[51] Int. Cl.[7] ..... B65B 67/08; B65B 35/50

[52] U.S. Cl. ..... 53/582; 53/540; 100/7; 414/741; 414/790.2; 901/8

[58] Field of Search ..... 100/2, 7; 53/582, 53/588, 589, 540, 447, 495, 504; 414/753, 790.2, 741, 738; 901/8

[56] References Cited

U.S. PATENT DOCUMENTS

| | | | |
|---|---|---|---|
| 3,579,944 | 5/1971 | Heywood . | |
| 4,352,620 | 10/1982 | Inaba et al. | 414/738 |
| 4,483,124 | 11/1984 | Ohba et al. . | |
| 4,498,381 | 2/1985 | Convey, Jr. | 100/7 |
| 4,538,511 | 9/1985 | Wise | 100/7 |
| 4,817,804 | 4/1989 | Kawano et al. | 53/686 |
| 4,870,807 | 10/1989 | Plalamidies et al. | 53/540 |
| 5,218,813 | 6/1993 | Seidel | 53/589 |
| 5,460,479 | 10/1995 | Neumann et al. | 414/790.2 |
| 5,617,784 | 4/1997 | St. John et al. | 100/7 |

FOREIGN PATENT DOCUMENTS

| | | |
|---|---|---|
| 335 631 | 10/1989 | European Pat. Off. . |
| BO96A 0284 | 5/1996 | Italy . |
| 2 087 832 | 6/1982 | United Kingdom . |

*Primary Examiner*—Linda Johnson
*Attorney, Agent, or Firm*—Pillsbury Madison & Sutro

[57] ABSTRACT

Banknotes directed along the formation channels of a machine for making up bundles are caused to accumulate into an ordered stack at the outlet of each channel. The machine utilizes a bundling unit equipped with a sliding carriage and a first gripper, of which the operation is piloted by sensors associated with each outlet and governed by a monitoring and control unit in such a way that the gripper will address the single outlet each time a stack is formed, then pick up the stack and pass it to a second gripper forming part of a translate and tilt unit; this same unit proceeds first to offer the stack of banknotes to a binder, by which two wrapping bands are applied to the two ends to complete the bundle, and thereafter to tilt the bundle into the path of a push rod which directs it toward a packaging and/or storage station.

16 Claims, 5 Drawing Sheets

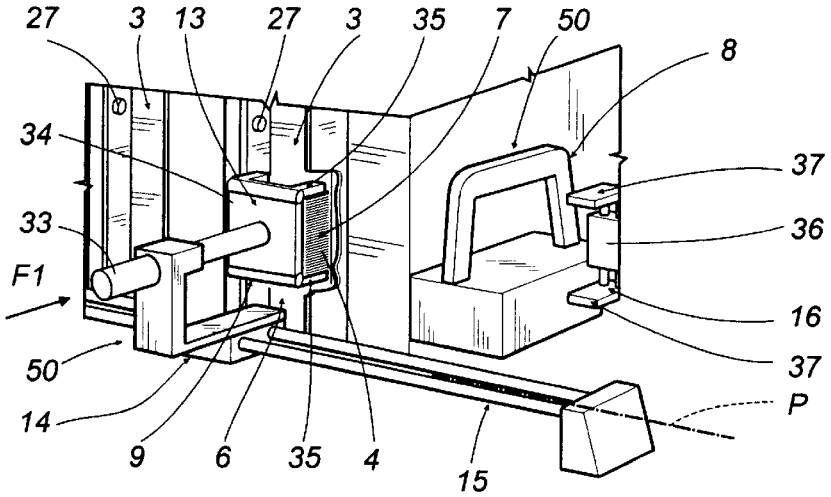
FIG.2
FIG.3
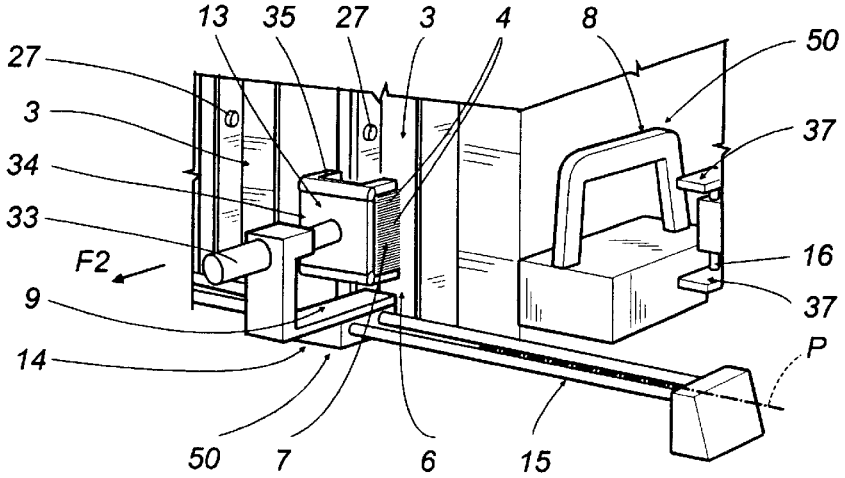
FIG.4
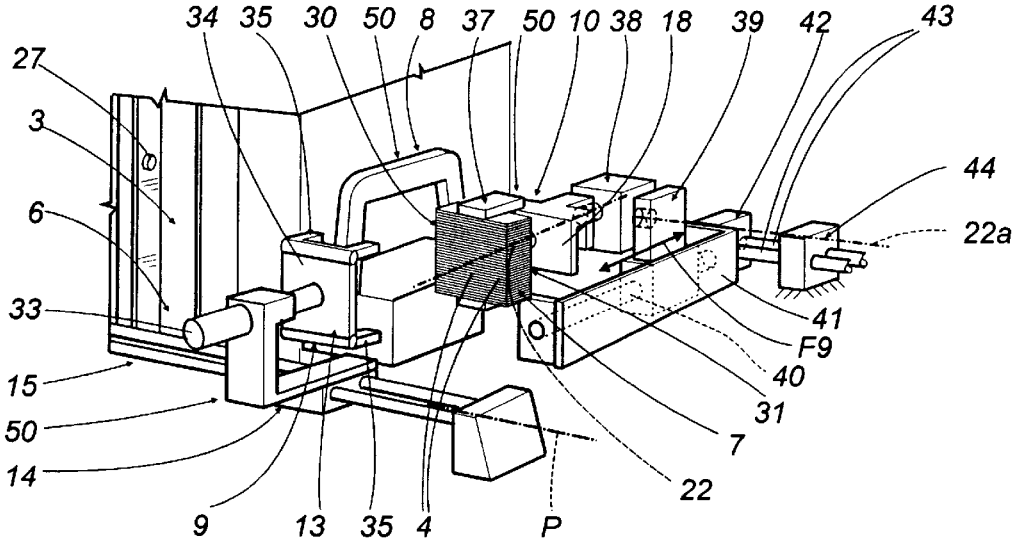

MACHINE FOR MAKING UP BUNDLES OF SHEETS, IN PARTICULAR BANKNOTES

BACKGROUND OF THE INVENTION

The present invention relates to a machine for making up bundles of sheets, in particular banknotes.

The invention is applicable advantageously to machines by which banknotes are ordered into stacks and arranged thereafter in bundles or stacks of bundles, and indeed reference will be made herein specifically to this type of application albeit no limitation in general scope is implied.

Machines of the type in question appear typically as a plurality of stacking modules equipped with respective formation channels and are designed to run an initial check on the banknotes for bundling. The modules are filled at their infeed ends with a succession of single notes, which might be of any given type, whereupon the notes are examined within the compass of the selfsame modules generally by optical means, and any defective items eliminated; thereafter, the banknotes are divided up according to denomination and/or type and directed toward respective independent outlets afforded by the formation channels.

In this manner, stacks of single banknotes are caused to form at each of the outlets in question, accumulating to a predetermined number before being taken up and transferred to a set of binders, one serving each module, by which each stack is secured with at least one wrapper or band in such a manner as to make up a relative bundle.

The prior art also embraces machines in which the banknotes caused to accumulate at the outlets of the single formation channels consist not in stacks of discrete notes, but rather in stacks of bundled notes already checked and bound with respective bands.

Albeit eminently effective in terms of their ability to check and stack the banknotes, machines of the type outlined above betray the drawback of being somewhat complex and costly.

The object of the present invention is to provide a machine for making up bundles from ordered stacks of banknotes, such as will remain free from the drawbacks associated with the prior art as outlined above.

A further object of the present invention is to provide a machine by which ordered stacks either of discrete banknotes or of bundled banknotes can be bound with equal ease.

SUMMARY OF THE INVENTION

The stated objects are realized according to the invention in a machine for making up bundles of sheets, and in particular banknotes, exhibiting a plurality of stacking modules each provided with a respective formation channel along which banknotes arriving from a checking station are directed in such a way as to form at least one ordered stack at an outlet afforded by the channels; the essential feature of such a machine is that it comprises a bundling unit associated at least with each pair of stacking modules, disposed and embodied in such a way as to apply at least one wrapping band to each of the stacks of banknotes formed at each of the outlets afforded by the formation channels of the stacking modules.

The present invention also relates to a method for making up bundles of sheets, in particular banknotes.

A further object of the present invention is to provide a method for making up bundles of banknotes such as can be implemented by the machine according to the present invention.

Such an object is realized in a method according to the present invention for making up bundles of sheets, in particular banknotes arriving from a checking station of a machine, which comprises the steps of feeding the banknotes along formation channels afforded respectively by a plurality of stacking modules making up the machine; forming the banknotes into at least one ordered stack at an outlet afforded by each formation channel of each stacking module; associating at least each pair of stacking modules with at least one bundling unit serving to bind the stacks of notes and, through the agency of the bundling unit, applying at least one wrapping band to each stack formed at each of the outlets afforded by the formation channels of the stacking modules.

BRIEF DESCRIPTION OF THE DRAWINGS

The invention will now be described in detail, by way of example, with the aid of the accompanying drawings, in which:

FIGS. 2 to 9 illustrate parts of the machine of FIG. 1 in a succession of operating steps required to make up a bundle of banknotes;

DESCRIPTION OF THE PREFERRED EMBODIMENTS

Figure 1:
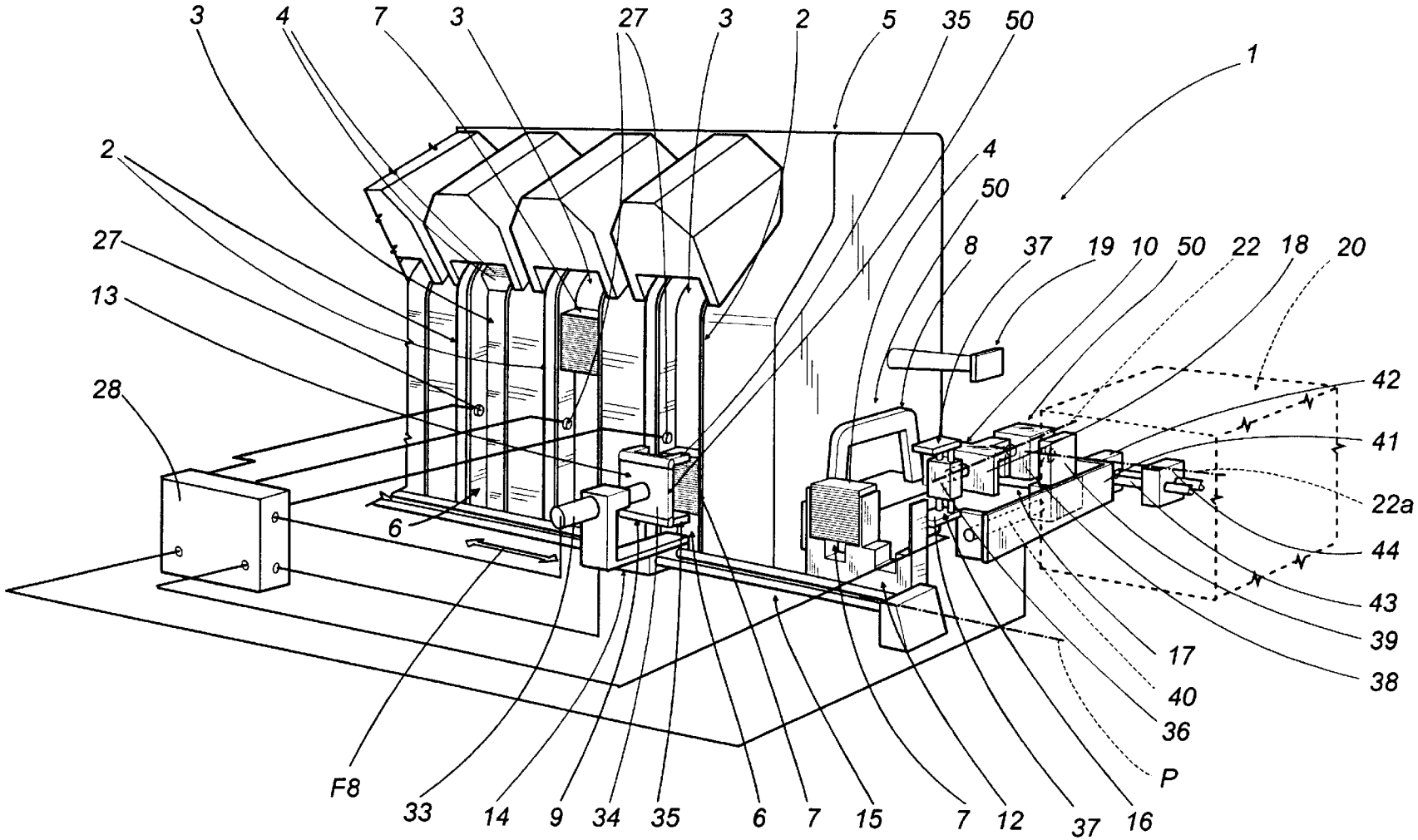
FIG. 1 illustrates a first embodiment of a machine according to the present invention, seen schematically in perspective and with certain parts omitted.
Figure 5:
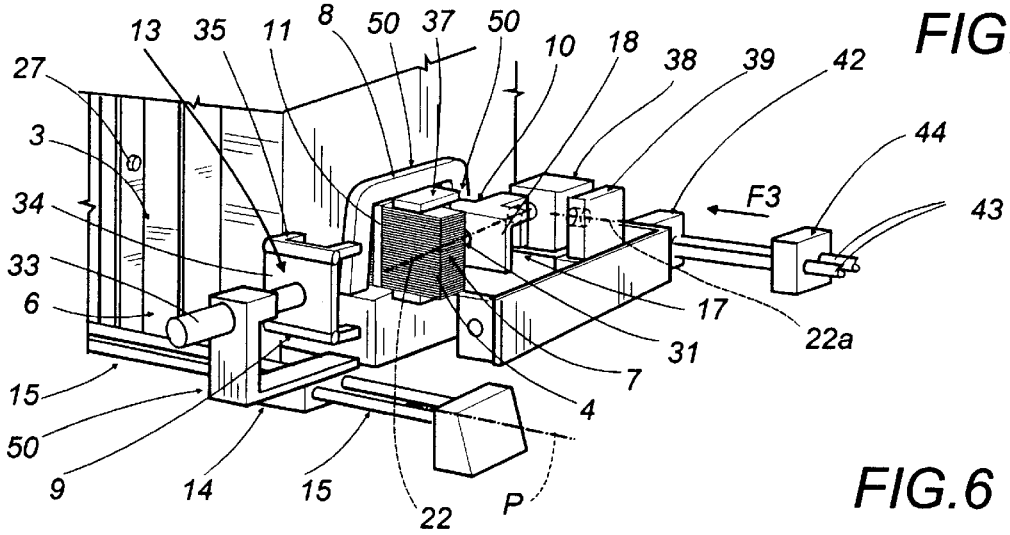
Figure 6:
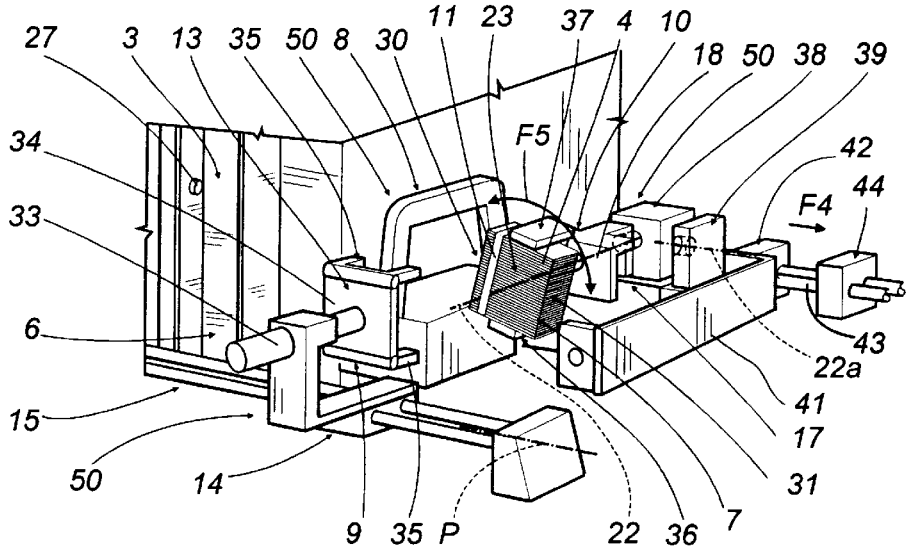

Referring to FIG. 1 of the accompanying drawings, 1 denotes a machine, in its entirety, for making up bundles 29 of sheets which in the case of the present disclosure are banknotes 4.

Such a machine 1 will comprise a plurality of stacking modules 2 affording respective formation channels 3, substantially of the type described in Italian patent application BO96A 000284, and counterpart U.S. Pat. No. 5,878,999, issued on Mar. 9, 1999, based on an application filed in the U.S. on May 23, 1997, by which banknotes 4 emerging from a checking station 5 (indicated schematically and in part in FIG. 1) are taken up and advanced in such a way as to collect at each outlet 6 of each channel 3 and form at least one ordered stack, denoted 7.

In the example of FIG. 1, the machine 1 disclosed incorporates a bundling unit 50 comprising first means 9 by which to pick up and transfer a stack 7 of the banknotes 4, and second means 10 by which the selfsame stack 7 is picked up and fed to a binder 8.

The aforesaid first pickup and transfer means 9 consist in a first gripper 13 carried by a first carriage 14, mounted slidably on respective ways 15 extending along a predetermined path P that passes substantially across the front of the stacking modules 2.

The gripper 13 comprises a first head 34 of which the dimensions are substantially identical to those of the stack 7, and arms 35 of U shape projecting bilaterally from the head 34, at the top and at the bottom respectively, such as will allow of taking up and maintaining a tight hold on the stack 7 of banknotes 4.

The head 34 is supported on the carriage 14 by way of a double acting linear actuator 33, in such a manner that the head 34 can move toward and away from a stack 7 occupying a formation channel 3.

The second pickup and feed means 10 consist in a second gripper 16, supported by a second head 36, to which the stack 7 of banknotes 4 is transferred from the first gripper 13. This gripper 16 in its turn comprises a pair of arms 37, likewise top and bottom, of which the geometry is complementary to that of the two U-shaped arms 35 presented by the first head 34, in such a way that the arms 37 are able to take up and retain a stack 7 of banknotes 4 accommodated by the first gripper 13 and thus enable the transfer of the stack 7 from the first gripper 13 to the second gripper 16.

The second head 36 is carried by a supporting member 18 forming part of a unit 17 of which the function is to translate and tilt the stack 7. The head 36, hence also the gripper 16, is capable of rotation relative to the supporting member 18 about a first axis of rotation 22 disposed substantially perpendicular to the larger face 23 of the stack 7 of banknotes 4.

As indicated in FIGS. 1 and 4, the translate and tilt unit 17 further comprises a hinge 38 that serves also to carry the supporting member 18; the hinge 38 in its turn is carried by a bracket 39 mounted slidably to the way 40 of a support frame 41 and rendered capable thus of movement in the direction of the arrow denoted F9.

The support frame 41 is cantilevered from a bar 42 able to slide along a pair of tubular ways 43 carried by a fixed structure denoted 44. The aforementioned binder 8 occupies a fixed position to one side of the machine 1, alongside the translate and tilt unit 17.

The supporting member 18 is rotatable relative to the hinge 38 about the first axis 22, whilst the hinge 38 itself is rotatable in relation to the bracket 39 about a second axis 22*a* substantially perpendicular to the first axis 22.

With the bar 42 able to slide thus on the tubular ways 43, the support frame 41 is rendered capable of movement toward and away from the binder 8.

Turning now to the operation of the machine, it will be discernible from the foregoing description and from the schematic illustrations of FIGS. 1, 2, 3 and 4 that the first carriage 14 is able to travel along the path P in the direction of the arrow denoted F8 in FIG. 1, in such a manner as to shuttle the first gripper 13 cyclically between a first station, which the gripper 13 occupies having drawn up to one of the stacking modules 2 and come to rest opposite the outlet 6 of the respective formation channel 3, and a second station at which the gripper 13 is distanced from the stacking modules 2, having reached the second pickup and feed means 10 and come to rest opposite the second gripper 16.

Observing the operating configuration that coincides with the first station, illustrated in FIGS. 1, 2 and 3, the first gripper 13 advances in the direction of the arrow denoted F1 from a retracted transfer position into a forward pickup position in which it engages the outlet 6 of the relative formation channel 3, whereupon the stack 7 of banknotes 4 formed previously in the channel 3 is taken up between the two arms 35. Having taken hold of the stack 7, the gripper 13 returns in the direction of the arrow denoted F2 to the retracted transfer position.

Likewise at the second station, as indicated in FIG. 4, the gripper 13 advances toward a forward position (not illustrated) at which the stack 7 is released to the second gripper 16, before returning to the retracted transfer position occupied previously.

As illustrated in FIG. 1, the machine 1 can be equipped with a magazine 12 positioned between the first pickup a nd transfer means 9 and the second pickup and feed means 10, of which the function is to take up ordered stacks 7 of the banknotes 4 from the first gripper 13, by which the stack 7 will effectively be deposited on the magazine 12, and pass them on to the second gripper 16. Accordingly, the magazine 12 creates a flow compensating facility between the first and the second pickup means 9 and 10 in the event that the operating speed of the two components in question should happen to differ.

Observing FIGS. 4 to 9, the translate and tilt unit 17 is designed to move cyclically through six successive operating positions of which a first, indicated in FIG. 4, is one in which the stack 7 of banknotes 4 is transferred from the first gripper 13 to the second gripper 16 and held between the relative arms 37. In the second operating position, illustrated in FIG. 5, the bar 42 moves along the tubular ways 43 in the direction of the arrow denoted F3, whereupon the entire unit 17 translates toward the machine in such a way as to offer a first end 30 of the bundle 7 of banknotes 4 to the binder 8, by which a first band 11 is placed around the selfsame end 30 of the stack 7 In the third operating position, shown in FIG. 6, the bar 42 moves along the ways 43 in the direction of the arrow denoted F4, whereupon the entire unit 17 is distanced from the machine and the stack 7 can be withdrawn from the binder 8 as a result. Still in the third operating position, the second gripper 16 rotates 180° about the first axis 22 of rotation in the direction of the arrow denoted F5, overturning the stack 7 in such a manner that a second end 31, remote from the first end 30, faces toward the binder 8.

Figure 7:
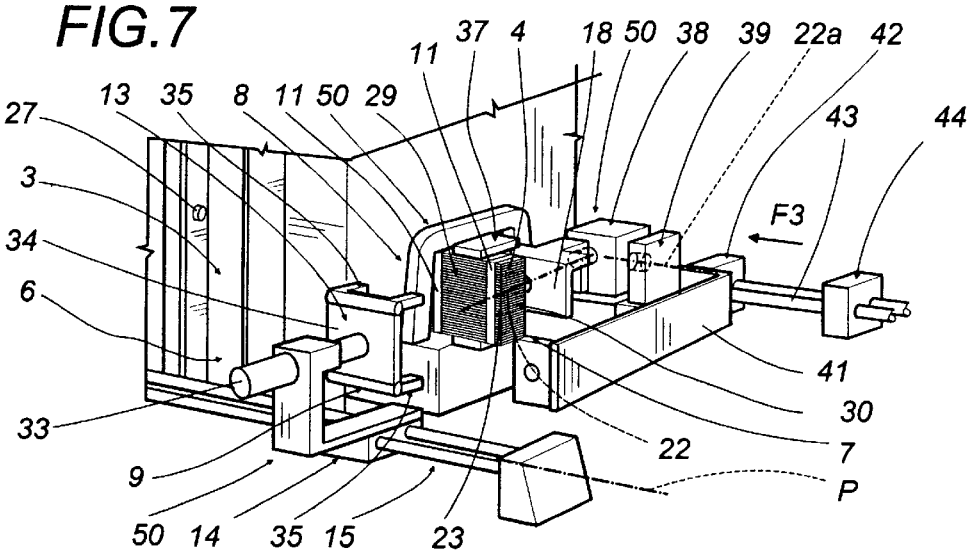
Figure 8:
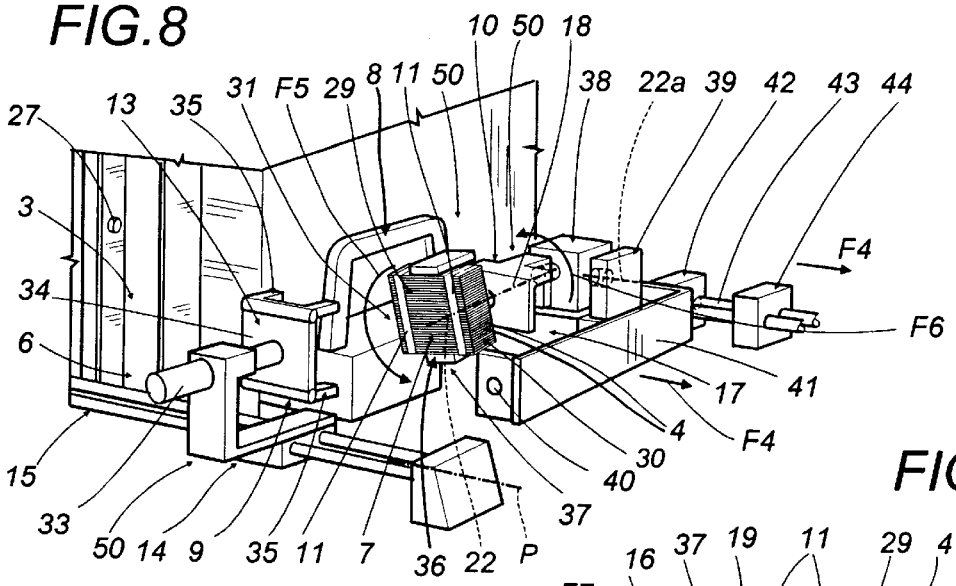

The fourth operating position indicated in FIG. 7 is in effect a repeat second operating position, inasmuch as the bar 42 again traverses along the tubular ways 43 in the direction of the arrow denoted F3, whereupon the entire unit 17 moves toward the machine and the second end 31 of the stack 7 of banknotes 4 is offered to the binder 8, by which a second band 11 is placed around this same end 31 to complete the bundle 29. Similarly, the fifth operating position illustrated in FIG. 8 is in effect a repeat third operating position, inasmuch as the bar 42 traverses along the ways 43 in the direction of the arrow denoted F4, whereupon the entire unit 17 moves away from the machine and the bundle 29 is thus distanced from the binder 8.

To facilitate the removal of the bundle 29 from the binder 8 during the distancing movement of the unit 17, the second head 36 will cause the bundle 29 to rotate about the first axis 22 of rotation in the direction of the arrow denoted F6, while the supporting member 18 rotates likewise about the same axis 22.

Figure 9:
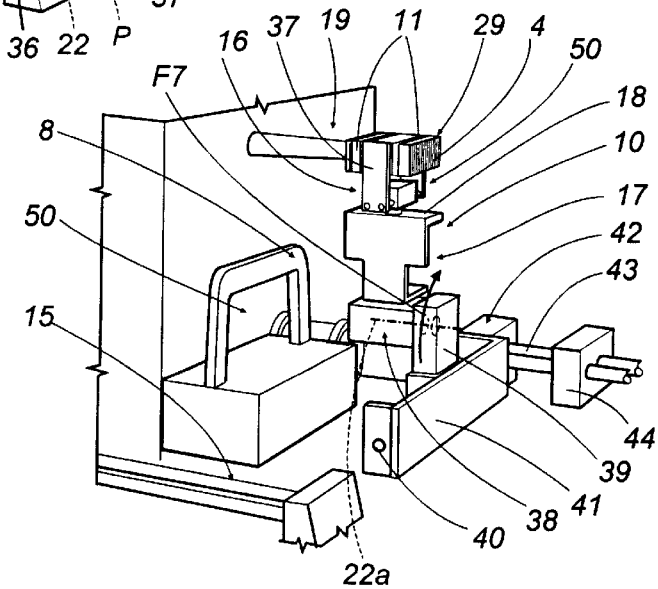

In the final operating position of the cycle, indicated in FIG. 9, the unit 17 is tilted approx 90° about the second axis 22*a* of rotation in the direction of the arrow denoted F7 so as to position the bundle 29 in alignment with a push rod 19. Operating synchronously with the arms 37 of the gripper 16, the push rod 19 is activated at the moment when the arms 37 are caused to release the bundle 29, which will be directed thereupon toward a packaging and/or storage station 20 indicated schematically in FIG. 1 by phantom lines. As shown in FIG. 9, the tilting movement of the unit 17 is made possible by the ability of the hinge 38 to rotate about the second axis 22*a* in relation to the bracket 39 by which it is supported.

The rotational movements of the second head 36 and of the supporting member 18 which carries the head, also of the hinge 38 which allows the tilting movement of the unit 17, are enabled by devices of conventional embodiment not illustrated in the drawings; the same applies in the case of the devices which enable the movements of the first carriage 14 along the relative ways 15, also the movements of the arms 35 of the first gripper 13 and the arms 37 of the second gripper 16. Indeed once familiar with the sequence of operations, any person skilled in the art will have no difficulty in selecting mechanisms and drive means suitable for its implementation.

To set the above operating cycle in motion, still with reference to FIG. 1, and to ensure that the successive movements and operating steps of the bundling unit 50 are properly coordinated, each formation channel 3 is equipped with a sensor 27 serving to verify and confirm that the formation of each stack 7 of banknotes 4 has been completed. The sensors 27 are connected on the output side to a monitoring and control unit indicated schematically by a block denoted 28, which in turn is connected on the output side to the first pickup and transfer means 9, to the binder 8 and to the second pickup and feed means 10.

The sequence of operations in question will be repeated cyclically for each formation channel 3, every time a signal is received from the sensor 27 confirming that a stack 7 of banknotes 4 has been completed and is ready at the respective outlet 6.

It will be appreciated also that in an embodiment of the machine 1 not actually illustrated in the drawings, the sequence of steps performed by the second pickup and feed means 10 in offering and removing the stack 7 to and from the binder 8, to allow the application of the two bands 11, could be performed directly by the first pickup and transfer means 9; in this instance, the relative gripper 13 would be equipped with arms 35 shaped in the same manner as the arms 37 of the second gripper 16 and the first head 34 able to rotate about the axis of the linear actuator 33.

Figure 10:
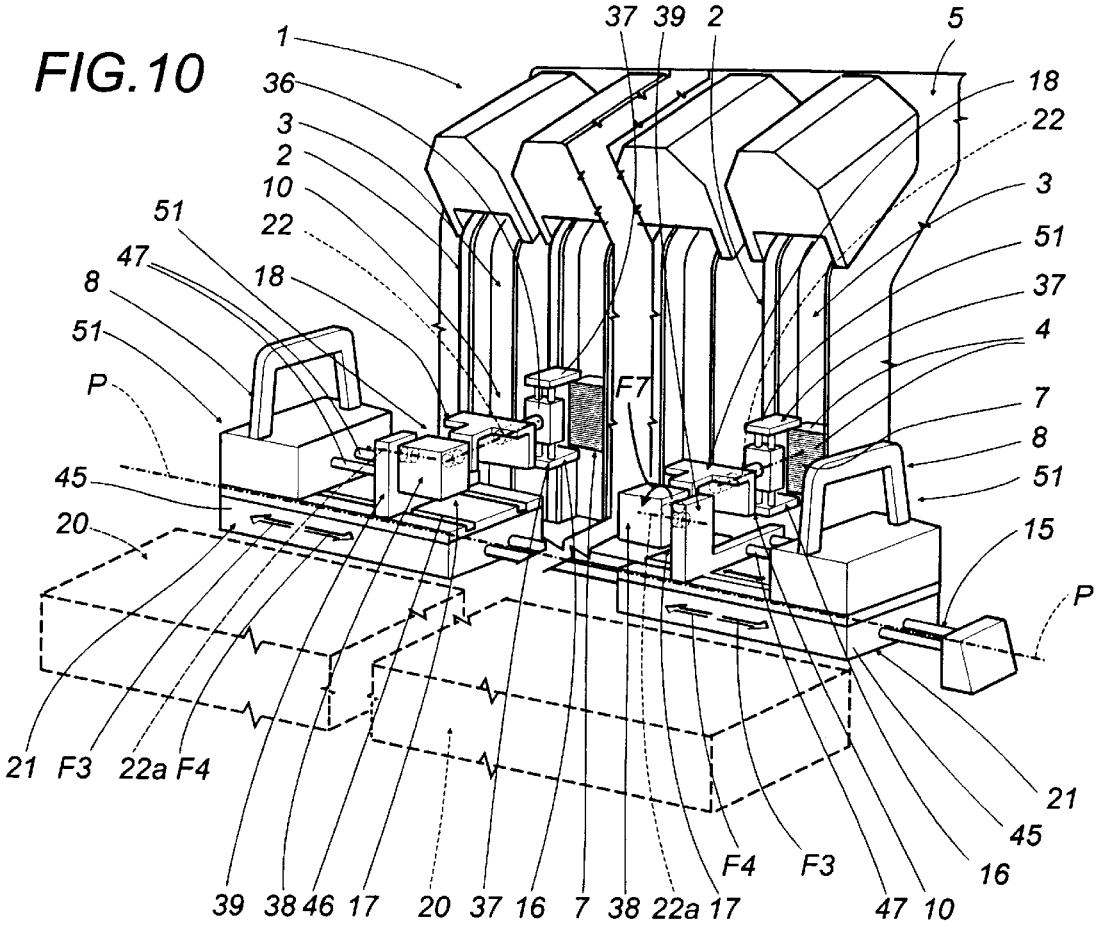
FIG. 10 illustrates a second embodiment of a machine according to the present invention, seen schematically in perspective and with certain parts omitted.

Referring to the example of FIG. 10, the fixed binder 8 is replaced by a binder 8 capable of movement along the predetermined path P, which passes substantially across the front of the stacking modules 2. The binder 8 is positionable at each of the outlets 6 afforded by the formation channels 3 of the stacking modules 2 whenever a stack 7 of banknotes 4 is completed and signalled as ready to be picked up at the relative outlet 6.

The bundling unit is denoted 51 in this example and will be seen to comprise a plurality of second pickup and feed means 10, each of which associated operationally with a relative binder 8.

The binder 8 and second pickup and feed means 10 are carried by further transfer means 21 comprising a carriage 45 capable of sliding movement on ways 15 extending along the predetermined path P, in the direction of the arrows denoted F3 and F4.

The second pickup and feed means 10 indicated in FIG. 10 are equivalent to the second means 10 shown in the embodiment of FIG. 1, and form part of the selfsame translate and tilt unit 17. The second gripper 16 is carried by the second head 36, which in turn is mounted to the supporting member 18 by way of a double acting linear actuator (not shown in FIG. 10) that allows the head 36 to move toward and away from the stack 7 occupying the formation channel 3. The gripper 16 is equipped in turn with a pair of arms 37, top and bottom respectively, between which the stack 7 of banknotes 4 is taken up and held. The head 36 and gripper 16 are able to rotate in relation to the supporting member 18 about a first axis 22, and the supporting member 18 is itself rotatable relative to the hinge 38 about the selfsame axis 22.

The hinge 38, which carries the supporting member 18, is mounted to a bracket 39 capable of sliding movement along a pair of tracks 46 afforded by an upward facing surface of the carriage 45 supporting the bracket 39. The bracket 39 in turn is mounted slidably to tubular ways 47 and capable thus of guided movement toward and away from the binder 8.

The hinge 38 can be rotated relative to the bracket 39 about a second axis 22*a* substantially perpendicular to the first axis 22.

In exactly the same manner as described for the embodiment of the machine 1 illustrated in FIG. 1, the translate and tilt unit 17 is capable of movement cyclically through six operating positions which are entirely equivalent to those described and illustrated in connection with the solution of FIG. 1, and therefore not shown in this instance.

In operation, accordingly, the unit 17 moves from a first operating position in which the gripper 16 picks up a stack 7 of banknotes 4 from the outlet 6 of each formation channel 3, to a second operating position in which the stack 7 is offered to the relative binder 7 in readiness for the application of the first band 11 to the first end 30 of the stack 7. To reach the second operating position, more exactly, the unit 17 rotates about the second axis 22*a* in the direction of the arrow denoted F7 through approximately 90°, pivoting on the hinge 38, whereupon the bracket 39 will move toward the binder 8 in the direction of the arrow denoted F3.

The third operating position coincides with the step of distancing the stack 7 from the binder 8, which is one of inducing a movement of the bracket 39 away from the binder in the direction of the arrow denoted F4.

The fourth operating position, which coincides with the application of a second band 11 to the second end 31 of the stack 7 remote from the first end 30, hence with the completion of the bundle 29, is assumed after the stack 7 has been flipped over by the gripper 16 and the bracket 39 translated along the tracks 46 afforded by the carriage 45, toward the binder 8, in the direction of the arrow denoted F3. Likewise in this instance, the stack 7 is overturned by a rotation of the gripper 16 relative to the supporting member 18 through 180° about the first axis 22 of rotation.

The fifth operating position coincides with the removal of the bundle 29 from the binder 8, and is produced by distancing the bracket 39 in the direction of the arrow denoted F4.

The final operating position to be assumed by the unit 17 is produced by tilting the bundle 29, the hinge 38 being rotated through a further 90° in the direction of the arrow denoted F7 and brought thus into alignment with a respective packaging and/or storage station 20, to which the bundle 29 is ultimately released.

In the solution of FIG. 10, as in the solution of FIG. 1, the various rotational movements whereby the unit 17 is allowed to tilt and translate toward and away from the binder 8 are brought about by devices of conventional embodiment not illustrated in the drawings.

Likewise in the example of FIG. 10, all operating steps of the machine are governed by the monitoring and control unit 28 in conjunction with the sensors 27, as in the example of FIG. 1.

In the event that just one wrapping band 11 is to be applied to the bundle, the unit 17 will take up only the first, second, third and last of the six operating positions, thus skipping the fourth and fifth positions which relate exclusively to the application of a second band 11.

Complementing the specification thus far, two important aspects of the machine 1 may profitably be highlighted.

Figure 11:
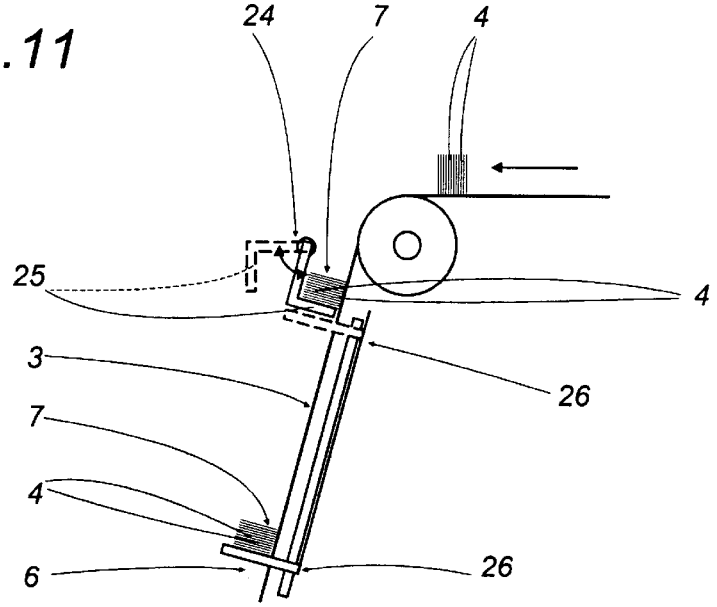
FIG. 11 illustrates one possible embodiment of a detail in FIGS. 1 and 10.

The first, referring to FIG. 11, is that each of the formation channels 3 will be equipped with a detent 24 positioned preceding the outlet 6 in the stacking direction and capable of moving between two limit positions: a first at-rest position, indicated by phantom lines in FIG. 11, in which the detent 24 is distanced from the channel 3 and the channel thus freed to allow the passage of the banknotes 4 toward the outlet 6, and a second operating position in which the banknotes 4 are intercepted by a part of the detent 24 affording a platform 25 disposed such that the banknotes 4 will accumulate to form a stack 7.

The detent 24 operates in conjunction with conventional means 26 of support and guidance associated with the relative formation channel 3, disposed and embodied in such a way that when the machine is in use, the stack 7 of banknotes 4 accumulating on the platform 25 of the detent 24 will be taken up and directed toward the outlet 6 of the channel each time the stack 7 currently occupying the outlet 6 is removed. Advantageously, this allows the machine to exploit longer pause times in implementing the sequences of operations performed by the first pickup and transfer means 9 and the second pickup and feed means 10.

Figure 12:
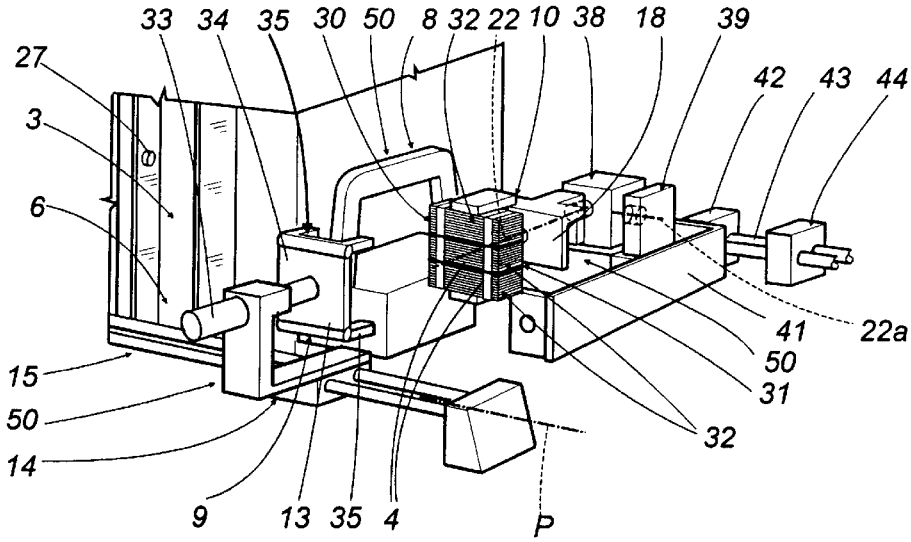
FIG. 12 illustrates a detail of FIG. 1 in one of the operating steps whereby a stack of bundles is made up.

The second aspect of importance, discernible in FIG. 12, is that the stack 7 of banknotes 4 may also consist in a plurality of single bundles 32 checked and made up previously, which need to be secured together with two bands 11. In this instance, the sequence of steps making up the operating cycle of the machine 1 remains the same as described above.

What is claimed:

1. A machine for making up bundles of sheets, said machine comprising:

a plurality of stacking modules having a front and each provided with a respective formation channel having an outlet, each said formation channel being disposed for receiving banknotes from a checking station and forming at least one ordered stack of banknotes at the outlet, the at least one ordered stack having a larger face; and a bundling unit associated with at least two of said stacking modules for applying at least one wrapping band to each of the stacks of banknotes formed at each of the outlets of the formation channels of said stacking modules;

wherein said bundling unit comprises:

a binder;

first movable pickup and transfer means operating independently of said binder and disposed for picking up a stack of banknotes from the outlet of a selected one of the at least two stacking modules and transferring the stack of banknotes that has been picked up to a position which is preparatory for the application of at least one wrapping band, wherein said first pickup and transfer means comprise:

first gripper means for taking up and holding at least one stack of banknotes;

first sliding carriage means supporting said first gripper means and being mounted for movement along a predetermined transfer path that passes substantially across the front of said stacking modules, said first sliding carriage means being movable cyclically between a first station in which said first sliding carriage means address one of said stacking modules and come to a halt opposite the outlet of the respective formation channel, where said first gripper means can move from a retracted transfer position to a forward position, pick up and hold the stack of banknotes accumulated internally of the formation channel and then return to the retracted position to allow transfer of the stack, and a second station, distanced from the stacking modules, at which said first sliding carriage means draw alongside said binder where said first gripper means can move from the retracted transfer position to a forward position;

wherein said machine further comprises pickup and feed means further comprising;

second gripper means; and a translate and tilt unit equipped with a supporting member to which said second gripper means are mounted, wherein, when said first sliding carriage means are positioned at the second station and said first gripper means are in the forward position, a stack of banknotes can be transferred from said first gripper means to said second gripper means;

wherein said translate and tilt unit is movable cyclically through at least four successive positions including: a first operating position in which a stack of banknotes is transferred to said second gripper means; a second operating position in which the stack of banknotes is offered to said binder in readiness for the application of at least one wrapping band to make up a bundle; a third operating position in which the bundle is distanced from said binder, and a final operating position in which the bundle is tilted into the path of a feed means associated with a packaging and/or storage station; and wherein said second gripper means are rotatable about a first axis extending substantially perpendicular to the larger face of a stack held by said second gripper means for overturning the stack.

2. A machine as in claim 1, comprising at least one flow compensating magazine located between the first pickup and transfer means and the second pickup and feed means, of which the function is to take up ordered stacks of banknotes from the first pickup and transfer means and supply them to the pickup and feed means.

3. A machine for making up bundles of sheets, said machine comprising:

a plurality of stacking modules having a front and each provided with a respective formation channel having an outlet, each said formation channel being disposed for receiving banknotes from a checking station and forming at least one ordered stack of banknotes at the outlet, the at least one ordered stack having a larger face; and a bundling unit associated with at least two of said stacking modules for applying at least one wrapping band to each of the stacks of banknotes formed at each of the outlets of the formation channels of said stacking modules;

wherein said bundling unit comprises:

a movable binder which is movable for addressing each of said outlets of said formation channels of said stacking modules at which a stack of banknotes is formed;

pickup and feed means associated with said binder for picking up a stack of banknotes from any one of said outlets and offering the stack which has been picked up to said binder in readiness for the application of at least one wrapping band; and sliding carriage transfer means supporting said binder and said pickup and feed means and being mounted for sliding movement along a predetermined transfer path passing substantially across the front of said stacking modules;

wherein said pickup and feed means comprise:

gripper means for taking up at least one stack of banknotes; and a translate and tilt unit equipped with a supporting member which supports said gripper means, wherein said translate and tilt unit is movable toward and away from said binder and is movable cyclically through at least four successive positions including:

a first operating position in which a stack of banknotes is transferred to said gripper means; a second operating position in which the stack of banknotes is offered to said binder in readiness for the application of at least one wrapping band to make up a bundle; a third operating position in which the bundle is distanced from said binder, and a final operating position in which the bundle is tilted into the path of a feed means associated with a packaging and/or storage station; and wherein said gripper means are rotatable about a first axis extending substantially perpendicular to the larger face of a stack held by said gripper means for overturning the stack.

4. A machine for making up bundles of sheets, said machine comprising:

a plurality of stacking modules having a front and each provided with a respective formation channel having an outlet, each said formation channel being disposed for receiving banknotes from a checking station and forming at least one ordered stack of banknotes at the outlet, the at least one ordered stack having a larger face; and a bundling unit associated with at least two of said stacking modules for applying at least one wrapping band to each of the stacks of banknotes formed at each of the outlets of the formation channels of said stacking modules;

wherein said bundling unit comprises:

a movable binder which comprises all components necessary for applying at least one wrapping band around each of the stacks of banknotes and which is movable for addressing each of said outlets of said formation channels of said stacking modules at which a stack of banknotes is formed; and pickup and feed means associated with said binder for picking up a stack of banknotes from any one of said outlets and offering the stack which has been picked up to said binder in readiness for the application of at least one wrapping band.

5. The machine according to claim 1 wherein said translate and tilt unit is movable cyclically through two further positions, prior to said final positions, the two further positions being: a fourth operating position in which the stack of banknotes is offered to said binder in readiness for the application of a second wrapping band to an end of the stack remote from the at least one wrapping band; and a fifth operating position in which the bundle is distanced from said binder.

6. The machine according to claim 3 wherein said translate and tilt unit is movable cyclically through two further positions, prior to said final positions, the two further positions being: a fourth operating position in which the stack of banknotes is offered to said binder in readiness for the application of a second wrapping band to an end of the stack remote from the at least one wrapping band; and a fifth operating position in which the bundle is distanced from said binder.

7. The machine according to claim 4 wherein said bundling unit further comprises:

sliding carriage transfer means supporting said binder and said pickup and feed means and being mounted for sliding movement along a predetermined transfer path passing substantially across the front of said stacking modules;

wherein said pickup and feed means comprise:

gripper means for taking up at least one stack of banknotes; and a translate and tilt unit equipped with a supporting member which supports said gripper means, and wherein said translate and tilt unit is movable toward and away from said binder and is movable cyclically through at least four successive positions including: a first operating position in which a stack of banknotes is transferred to said gripper means; a second operating position in which the stack of banknotes is offered to said binder in readiness for the application of at least one wrapping band to make up a bundle; a third operating position in which the bundle is distanced from said binder, and a final operating position in which the bundle is tilted into the path of a feed means associated with a packaging and/or storage station.

8. The machine according to claim 1, wherein each said formation channel comprises:

a detent positioned preceding said outlet in a stacking direction and movable between an at-rest position, where said detent is distanced from said formation channel and said formation channel is freed to allow the passage of banknotes toward said outlet, and an operating position in which the banknotes are intercepted by a part of said detent affording a platform disposed to allow the banknotes to accumulate to form a stack; and support and guidance means operable in conjunction with said detent for causing a stack of banknotes accumulating on said platform to be taken up and directed toward said outlet each time a stack previously occupying said outlet is removed by said first pickup and transfer means.

9. The machine according to claim 1, wherein each said formation channel comprises a sensor for verifying and confirming that the formation of each stack of banknotes has been completed, said sensor being connected to monitoring and control means which monitor movements and operating cycle steps performed by said bundling unit.

10. The machine according to claim 1, wherein each stack consists of a plurality of single bundles of banknotes, each of the single bundles of banknotes having been checked previously and bound with respective wrapping bands.

11. The machine according to claim 3, wherein each said formation channel comprises:

a detent positioned preceding said outlet in a stacking direction and movable between an at-rest position, where said detent is distanced from said formation channel and said formation channel is freed to allow the passage of banknotes toward said outlet, and an operating position in which the banknotes are intercepted by a part of said detent affording a platform disposed to allow the banknotes to accumulate to form a stack; and support and guidance means operable in conjunction with said detent for causing a stack of banknotes accumulating on said platform to be taken up and directed toward said outlet each time a stack previously occupying said outlet is removed by said pickup and feed means.

12. The machine according to claim 3, wherein each said formation channel comprises a sensor for verifying and confirming that the formation of each stack of banknotes has been completed, said sensor being connected to monitoring and control means which monitor movements and operating cycle steps performed by said bundling unit.

13. The machine according to claim 2, wherein each stack consists of a plurality of single bundles of banknotes, each of the single bundles of banknotes having been checked previously and bound with respective wrapping bands.

14. The machine according to claim 4, wherein each said formation channel comprises:

a detent positioned preceding said outlet in a stacking direction and movable between an at-rest position, where said detent is distanced from said formation channel and said formation channel is freed to allow the passage of banknotes toward said outlet, and an operating position in which the banknotes are intercepted by a part of said detent affording a platform disposed to allow the banknotes to accumulate to form a stack; and support and guidance means operable in conjunction with said detent for causing a stack of banknotes accumulating on said platform to be taken up and directed toward said outlet each time a stack previously occupying said outlet is removed by said pickup and feed means.

15. The machine according to claim 4, wherein each said formation channel comprises a sensor for verifying and confirming that the formation of each stack of banknotes has been completed, said sensor being connected to monitoring and control means which monitor movements and operating cycle steps performed by said bundling unit.

16. The machine according to claim 4, wherein each stack consists of a plurality of single bundles of banknotes, each of the single bundles of banknotes having been checked previously and bound with respective wrapping bands.

* * * * *